US005262790A

United States Patent [19]

Russo

[11] Patent Number: 5,262,790

[45] Date of Patent: Nov. 16, 1993

[54] ANTENNA WHICH ASSURES HIGH SPEED DATA RATE TRANSMISSION LINKS BETWEEN SATELLITES AND BETWEEN SATELLITES AND GROUND STATIONS

[75] Inventor: Pasquale Russo, Rome, Italy

[73] Assignee: Space Engineering S.r.l., Rome, Italy

[21] Appl. No.: 768,235

[22] PCT Filed: May 23, 1991

[86] PCT No.: PCT/IT91/00044

§ 371 Date: Oct. 11, 1991

§ 102(e) Date: Oct. 11, 1991

[87] PCT Pub. No.: WO91/19332

PCT Pub. Date: Dec. 12, 1991

[30] Foreign Application Priority Data

May 31, 1990 [IT] Italy ..... 48022 A/90

[51] Int. Cl.[5] ..... H01Q 1/38; H01Q 21/00

[52] U.S. Cl. ..... 343/700 MS; 343/844

[58] Field of Search ..... 343/700 MS, 897, 844

[56] References Cited

U.S. PATENT DOCUMENTS 3,290,688 12/1966 Kraus ..... 343/897

4,079,268 3/1978 Fletcher et al. ..... 343/700 MS 4,376,938 3/1983 Toth et al. ..... 343/700 MS

*Primary Examiner*—Michael C. Wimer

*Attorney, Agent, or Firm*—Herbert Dubno

[57] ABSTRACT

An antenna is composed of a number of subarray radiating elements, with an aperiodic geometry, which assures connections between satellites and between satellites and ground stations. The aperiodic structure makes it possible to eliminate possible interference acting on the connection. The possible presence of the array grating lobes during steering of the array beams in the angular sector of interest is reduced. The presence of a grating lobe within the field of view which can cause interference with another low orbiting satellite is avoided, so as to improve reception quality characteristics. The invention is applicable to microwave antennas and space-borne systems by eliminating the presence of grating lobes in the field of view.

2 Claims, 2 Drawing Sheets

ANTENNA WHICH ASSURES HIGH SPEED DATA RATE TRANSMISSION LINKS BETWEEN SATELLITES AND BETWEEN SATELLITES AND GROUND STATIONS

CROSS REFERENCE TO RELATED APPLICATIONS

This application is a national phase of PCT/IT 91/00044 filed May 23, 1991 and based, in turn, upon Italian National Application 48 022A/90 filed May 31, 1990 under the International Convention.

FIELD OF THE INVENTION

My present invention relates to an antenna formed by a set of subarrays arranged in an aperiodic geometry to provide a perfect link between satellites and between satellites and ground stations.

More particularly, this invention relates to an aperiodic configuration of the subarrays and its application to space-borne systems.

BACKGROUND OF THE INVENTION

In the field of phased array antennas, where elementary radiators with dimensions of several wave lengths are utilized, one of the most pernicious problems was the presence of the grating lobes during the scanning of the beam, i.e. a grating lobe which enters into the field of view of a satellite in low orbit, deteriorating the reception quality characteristics.

It is well known that an half-array beam scan angle in the range of ten to thirteen degrees for the link between a geostationary satellite and a low orbit satellite is necessary. In order to keep the radio frequncy link (as the satellite orbits at an altitude of 36000 kilometers) in this field of view undesirable interference effects due to grating lobes, which arise during the connection, should be avoided.

OBJECTS OF THE INVENTION

It is, therefore, the principal object of the present invention to provide a phased array antenna for the purposes described, namely as a link between satellites and between satellites and ground stations whereby the presence of grating lobes during scanning is avoided in the field of view.

Another object of this invention is to provide an improved antenna whereby the drawbacks of earlier systems provided with periodic arrays are provided.

SUMMARY OF THE INVENTION

These objects and others which will become more readily apparent hereinafter are attained, in accordance with the invention by providing an antenna in which the entire area of the antenna consists of subarrays disposed in mutually adjacent relationship so that the entire antenna array is preferably a rectangle perfectly filled with the subarrays and the subarrays are themselves rectangular but deposited aperiodically so that, in scanning across the array a periodicity is avoided and, during beam scanning, grating lobes do not enter the field of view.

The array can be composed of subarrays which have a plurality of radiating elements preferably in the form of patches, for example, 8 patches, which can be photoetched on the subarray.

More particularly, an antenna according to the invention can comprise:

a rectangular phased array of mutually adjacent rectangular subarrays having an aperiodic configuration and perfectly filling a rectangular area of the phased array, each of the rectangular subarrays having a length twice a width of the subarray and formed with eight radiating elements spaced apart in two rows of four radiating elements each with the radiating elements of the rows being equidistant from one another and the radiating elements of each row being at the same distance from the corresponding element of the other row as the radiating elements of each row are spaced apart;

a first series of the subarrays extending horizontally consisting essentially of groups of two successive horizontal subarrays separated by a vertical subarray;

a second series of the subarrays adjacent the first series extending horizontally and consisting essentially of a succession of another vertical subarray, a horizontal subarray, a further vertical subarray and a vertical subarray extending into the second series from the first series;

a third series of the subarrays adjacent the second series extending horizontally and consisting essentially of a succession of a vertical subarray extending into the third series from the second series, a horizontal subarray, another vertical subarray extending into the third series from the second series, and another vertical subarray;

a fourth series of the subarrays adjacent the third series extending horizontally and consisting essentially of a succession of two vertical subarrays, a horizontal subarray and a vertical subarray extending into the fourth series from the third series;

a fifth series of the subarrays adjacent the third series extending horizontally and consisting essentially of a succession of two vertical subarrays extending into the fifth series from the fourth series, another vertical subarray and a horizontal subarray; and a sixth series of the subarrays adjacent the third series extending horizontally and consisting essentially of a succession of a horizontal subarray, a vertical subarray extending into the sixth series from the fifth series, and another horizontal subarray;

the phased array being provided with a scanner whereby, upon scanning of the phased array, no grating lobe enters a field of view of the phased array.

In its preferred application, this invention pertains to a satellite borne system, but it can be employed in other fields in which similar problems have to be solved.

In the specific application presently preferred by the inventor, the antenna is particularly suitable for application to systems interconnecting satellites and to systems interconnecting satellites and ground stations.

A low orbit satellite transmits data at high speed and these data are received by the satellite in a geostationary orbit, and are then transmitted to the ground.

Due to low orbiting satellite movement, the geostationary satellites must be able to provide the connection with the low orbit satellite throughout the entire field of view and the geostationary satellite must position the receiving/transmitting beam in any angular position inside a sector of interest of ten degrees.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

With the presented invention it is possible to utilize single radiating elements in any configuration. This makes it possible to obtain very good values for the efficiency of the radiators as it is possible to choose a distance at will, between the radiating elements (for example patches) which form the radiators and such as to minimize the degradation of the electric performances due to the coupling effect between the above mentioned radiating elements.

This layout offers ease of manufacturing the power division network which guarantees adequate exitation coefficients for any single radiating element, as in the version preferred by the inventor, the radiator is composed of eight patches.

With a same minimum distance of grating lobes from the main lobe, this kind of structure allows a reduction in the number of subarrays/radiators which constitute the array, also keeping constant the total area of the array, as its aperiodicity guarantees the possibility to utilize a major area for each radiator.

It is a well known fact that the implementation of an active or passive antenna requires a lot of devices, some of which may be active, or passive, connected with the output of each radiator.

Thus, there is the opportunity to decrease the number of radiators, with consequent reduction of manufacturing time and costs.

Figure 4:
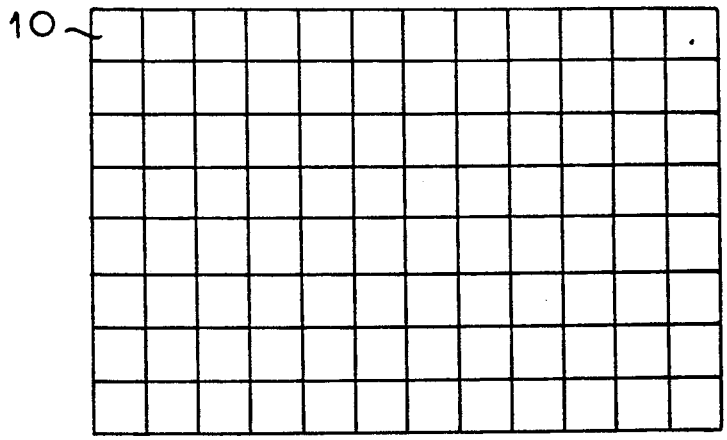
FIG.4 PRIOR ART
FIG. 4 is a diagram similar to FIG. 1 of a traditional periodic structure.
Figure 5:
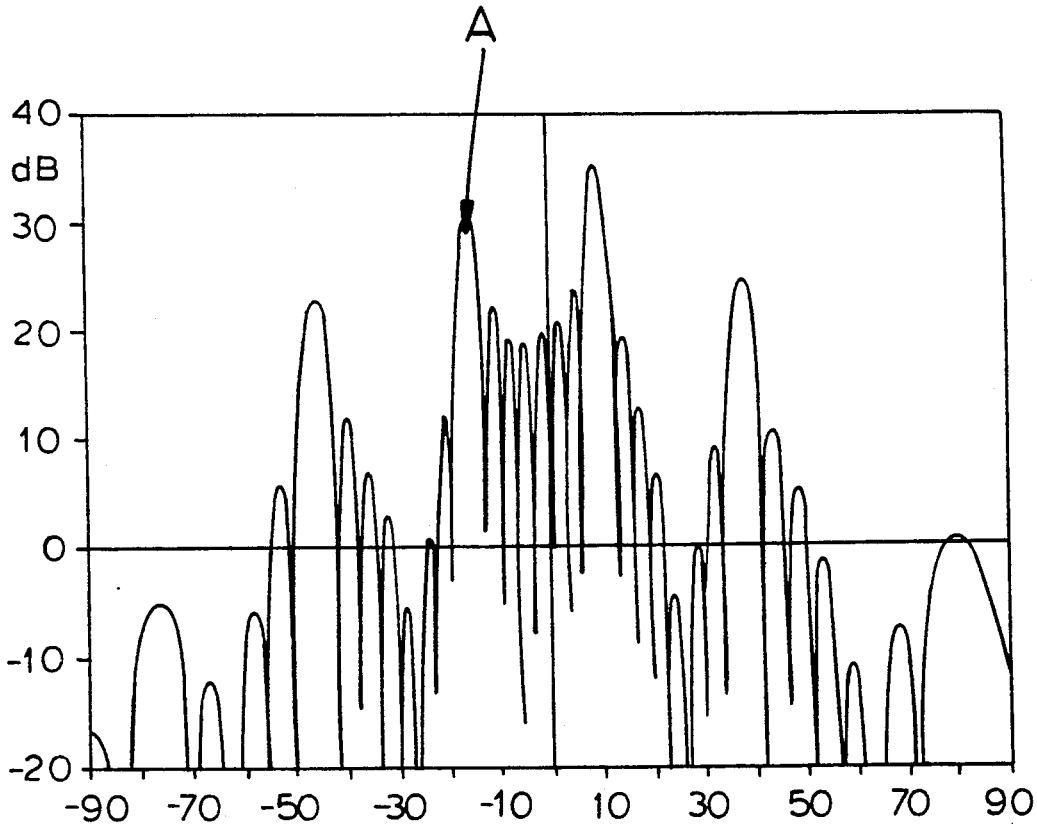
FIG 5 PRIOR ART
FIG. 5 is a graph of a radiation pattern of a periodic array antenna in which the undesired periodic lobe at the limit of the angular sector of interest is visible.

More specifically, FIG. 4 shows a prior art configuration of an antenna array which is periodic, i.e. made up of subarrays 10 in mutually continuous relationship so that in scanning across each horizontal series or each vertical series, the lobes A shown in FIG. 5 are produced. These lobes are the grating lobes occupying the field of view of the antenna array.

Figure 1:
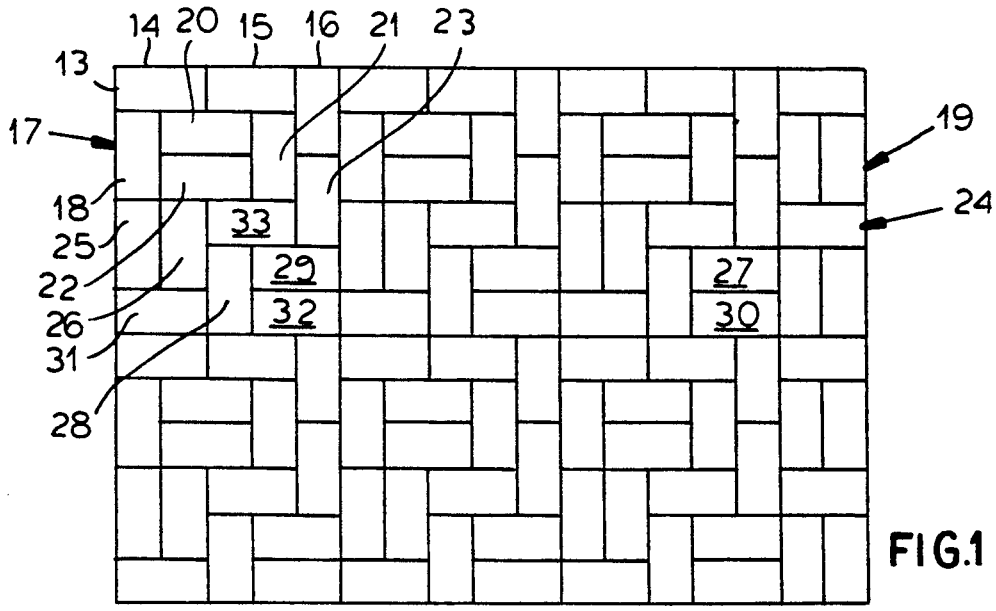
FIG. 1 is a diagram in the form of an elevational view configuration of an array antenna.
Figure 3:
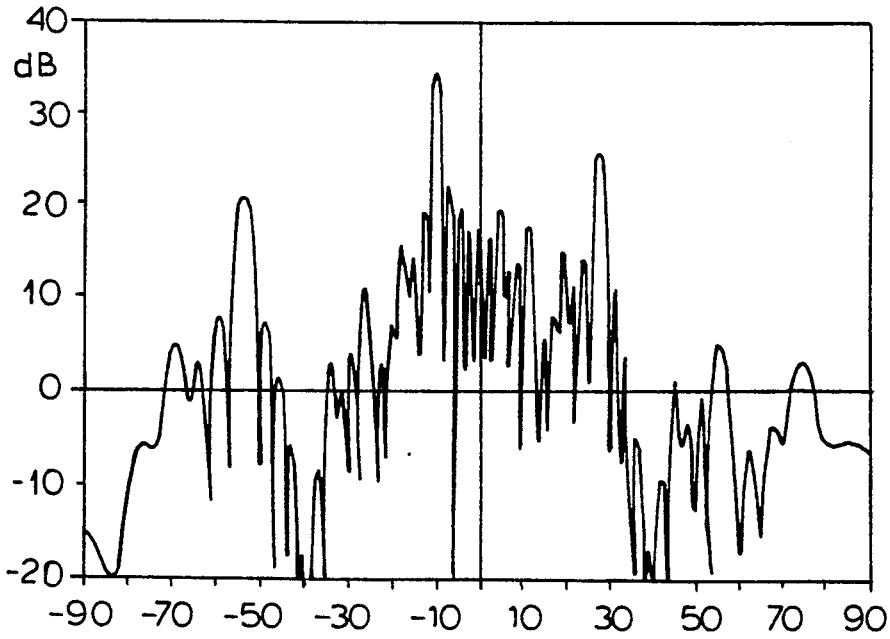
FIG. 3 is a graph of a pattern of an aperiodical array antenna, from which the suppression of the undesired lobe periodicity can be seen.

With the aperiodic configuration of the antenna shown in FIG. 1, these significant grating lobes in the field of view are avoided (compare FIG. 3, which represents the pattern achieved with the antenna of FIG. 1, with FIG. 5 representing the pattern achieved with the periodic antenna array of FIG. 4.

Figure 2:
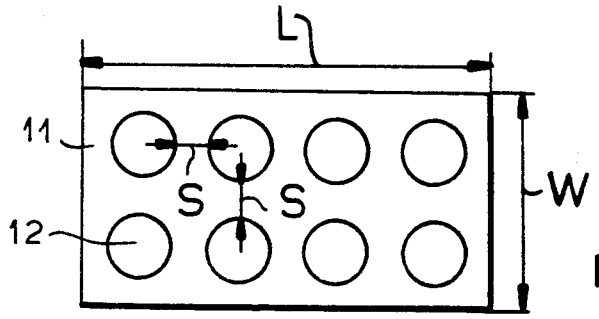
FIG. 2 is a Schematic representation of a possible microstrip element.

As can be seen from FIG. 2, each subarray 11 is rectangular with a length L equal substantially to twice its width W and provided with 8 patches 12 which can be applied by photoetching, in two rows with the spacing S of the patches 12 of both rows being the same as the spacing between the patches of the two rows.

A suitable aperiodic configuration as shown in FIG. 1 can have a first series 13 of subarrays 11 formed by two horizontal subarrays 14 and 15 followed by a vertical subarray 16 in a repeating pattern. The second series 17 can have a vertical subarray 18 reaching into the third series 19, a horizontal subarray 20, another vertical subarray 21 and the vertical subarray 16 which extends into the second series.

The third series 19 can also have a horizontal subarray 22 and the vertical subarrays 21 and 18 in addition to a subarray 23 reaching into the fourth series 24. The fourth series 24 can consist of two vertical subarrays 25, 26, a horizontal subarray 33 and the vertical subarray 23.

The fifth series 27 will have vertical subarrays 25 and 26 reaching into it from the fourth subarray, a further vertical subarray 28 and a horizontal subarray 29.

Finally, the sixth subarray 30 will have a horizontal subarray 31 followed by the subarray 28 and a subarray 32 which is also horizontal.

The set of six series can repeat vertically.

This aperiodic configuration ensures in the field of view of each 10° sector, for example, a fully aperiodic result which is represented in FIG. 3 and is free within that field of view from the substantial grating lobes capable of causing interference in the manner described.

I claim:

1. An antenna for high-rate data transmission for a satellite, comprising:

a rectangular phased array of mutually adjacent rectangular subarrays having an aperiodic configuration and perfectly filling a rectangular area of the phased array, each of said rectangular subarrays having a length twice a width of the subarray and formed with eight radiating elements spaced apart in two rows of four radiating elements each with the radiating elements of the rows being equidistant from one another and the radiating elements of each row being at the same distance from the corresponding element of the other row as the radiating elements of each row are spaced apart;

a first series of said subarrays extending horizontally consisting essentially of groups of two successive horizontal subarrays separated by a vertical subarray;

a second series of said subarrays adjacent said first series extending horizontally and consisting essentially of a succession of another vertical subarray, a horizontal subarray, a further vertical subarray and a vertical subarray extending into the second series from said first series;

a third series of said subarrays adjacent said second series extending horizontally and consisting essentially of a succession of a vertical subarray extending into said third series from said second series, a horizontal subarray, another vertical subarray extending into said third series from said second series, and another vertical subarray;

a fourth series of said subarrays adjacent said third series extending horizontally and consisting essentially of a succession of two vertical subarrays, a horizontal subarray and a vertical subarray extending into said fourth series from said third series;

a fifth series of said subarrays adjacent said fourth series extending horizontally and consisting essentially of a succession of two vertical subarrays extending into said fifth series from said fourth series, another vertical subarray and a horizontal subarray; and a sixth series of said subarrays adjacent said fifth series extending horizontally and consisting essentially of a succession of a horizontal subarray, a vertical subarray extending into said sixth series from said fifth series, and another horizontal subarray;

said phased array being capable of scanning such that no grating lobe enters a field of view of the phased array.

2. The antenna defined in claim 1 wherein said elements are circular radiating patches photoetched on said subarrays.

* * * * *